United States Patent [19]

Albertson et al.

[11] 4,258,783

[45] Mar. 31, 1981

[54] BOILING HEAT TRANSFER SURFACE, METHOD OF PREPARING SAME AND METHOD OF BOILING

[75] Inventors: Clarence E. Albertson, Villa Park; George M. Nichols, Evanston; John N. Rasmussen, Des Plaines, all of Ill.

[73] Assignee: Borg-Warner Corporation, Chicago, Ill.

[21] Appl. No.: 10,458

[22] Filed: Feb. 8, 1979

Related U.S. Application Data

[62] Division of Ser. No. 847,637, Nov. 1, 1977, Pat. No. 4,186,063.

[51] Int. Cl.[3] ..... F28F 13/18

[52] U.S. Cl. ..... 165/133; 62/527; 165/180

[58] Field of Search ..... 165/133, 180, DIG. 10; 62/527; 428/304, 309, 550

[56] References Cited

U.S. PATENT DOCUMENTS

| | | | |
|---|---|---|---|
| 3,384,154 | 5/1968 | Milton | 165/180 |
| 3,696,861 | 10/1972 | Webb | 165/133 |
| 3,768,290 | 10/1973 | Zatell | 165/133 X |
| 3,789,915 | 2/1974 | Ford | 165/133 |
| 3,906,604 | 9/1975 | Kakizaki et al. | 165/133 X |
| 3,990,862 | 11/1976 | Dahl et al. | 165/133 |
| 4,018,264 | 4/1977 | Albertson | 165/133 |
| 4,050,507 | 9/1977 | Chu et al. | 62/527 |
| 4,064,914 | 12/1977 | Grant | 165/133 |
| 4,129,181 | 12/1978 | Janowski et al. | 165/133 |

OTHER PUBLICATIONS

Butler et al., Improved Pool Boiling Heat Transfer to Helium from Treated Surfaces and its Application to Superconducting Magnets, Ind. J., Heat Mass Transfer, vol. 13, No. 1, pp. 105–115, (1970).

Tubular Hollow Cathode Sputtering onto Substrates of Complex Shape, Thorton et al., J. Vac. Sci. Technol., vol. 12, No. 1, Jan./Feb. 1975, pp. 93–97.

*Primary Examiner*—Sheldon J. Richter

*Attorney, Agent, or Firm*—William S. McCurry

[57] ABSTRACT

Improved nucleate boiling cavities are provided in a heat exchange surface by mechanically forming indentations on the heat transfer surface and then electrodepositing a metal on the pitted surface at a high current density followed by strengthening at lower current densities. Also described is a method of transferring heat from a warm fluid to a boiling liquid utilizing the improved nucleate boiling structure.

1 Claim, 7 Drawing Figures

TEST CONDITIONS

WATER TEMPERATURE = 50°F (AT LINE)

REFRIGERANT TEMP. = 36°F

WATER FLOW RATE = 9.90 G.P.M.

WATER TYPE = TAP.

BOILING HEAT TRANSFER SURFACE, METHOD OF PREPARING SAME AND METHOD OF BOILING

This is a division of application Ser. No. 847,637 filed Nov. 1, 1977 now U.S. Pat. No. 4,186,063.

BACKGROUND AND SUMMARY OF THE INVENTION

The present invention relates to boiling heat transfer surfaces which are provided on a heat exchange wall surface to enhance nucleate boiling and thereby improve the heat transfer action of a boiling liquid such as a halocarbon refrigerant. It is well known that nucleate boiling in a heat transfer apparatus is improved when the heated wall portion through which heat is transmitted from a warm fluid to a boiling liquid has its surface made porous by the formation of cavities in the heated wall portion.

U.S. Pat. No. 3,384,154 teaches that the radii of the cavities provided in the heated wall portion can be controlled by the size of the sintered powder coatings utilized to make the nucleate boiling surface.

U.S. Pat. No. 3,906,604 controls the nucleate boiling cavity size by machining the metal substrate to create protrusions which are frictionally rubbed and stretched to form the cavities.

U.S. Pat. Nos. 3,696,861 and 3,768,920 utilize bent-over tube fins to create elongated nucleate boiling cavities.

German Publication No. 2,510,580 discloses heat pipe surfaces wherein the surface is first mechanically roughened by wire brushing to form close uniform scratches and then electroplated to form nucleate boiling cavities.

U.S. Pat. No. 4,018,264 discloses a boiling heat transfer surface wherein the nucleate boiling cavities are made by electrodepositing copper dendrites on a copper surface at a high current, copper plating the dendrites or nodules and then rolling the dendritic surface to partially compact the nodules.

The present invention relates to a heat transfer surface having improved cavities to promote nucleate boiling; an improved method for preparing such cavities; and an improved method of nucleate boiling which utilizes the improved cavity structures. The present method for preparing the improved nucleate boiling cavities comprises deforming the metal substrate to form indentations in the metal in the form of non-continuous pits or craters and then electrodepositing a metal on the periphery of the pits or craters at a high current density and then at a normal plating current, from a special bath, to provide honeycomb-like surfaces which optimize nucleate boiling augmentation for particular fluids, especially halocarbon refrigerants utilized in refrigerator systems.

The cavity diameters in the plated coatings are directly related to the size of the pits or craters formed on the metal substrate. In the case of sandblasting, the metal deformation is made by grits having a mesh size of 10 to 200. In the case of deforming by knurling, the cavity diameter is determined by the size and number per square inch of the projections on the knurling tool. A pre-plated surface having from 100 to 350 (10,000 to 122,500 per square inch) knurls per inch is preferred in making the present heat exchange surface. It has been found that a knurling tool having 240 knurls per square inch provides pits or craters which, when electroplated, form excellent nucleate boiling cavities in the heated wall surface of a heat exchanger using halocarbon refrigerants such as R-12.

When the heat exchange surface is deformed by sandblasting, silicon carbide of 10–200 mesh, glass beads of 10–200 mesh and ground slag of 60 mesh have been used; silicon carbide of 60 mesh size is preferred for use in R-12.

DESCRIPTION OF THE PREFERRED EMBODIMENTS

In order to best understand the principles of the present invention, the following examples are provided for illustrative purposes only.

Figure 1:
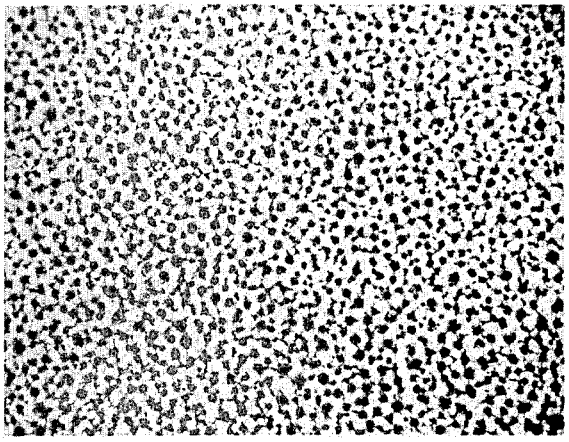
FIG. 1 is a photomicrograph (X30) of the surface of a copper tube plated in accordance with the present invention utilizing 100 mesh silicon carbide grit to deform the surface prior to plating.

The surfaces shown in FIGS. 1, 2 and 3 were prepared in the following manner:

EXAMPLE 1

A $\frac{3}{4}$ inch O.D. copper refrigeration tube having an overall length of about 5 feet and a wall thickness of about 0.035 inch was cleaned to remove any cuprous oxide and dirt and then mechanically deformed by sandblasting the tube with silicon carbide grit, 100 mesh; etched in a $HNO_3$—$H_2SO_4$ acid bath at room temperature for 15 seconds; rinsed with water and immersed in a copper plating bath comprising 160 grams per liter of copper sulfate and 60 grams per liter of sulfuric acid. The tube rotated at 7–22 r.p.m. in a cathode fixture was electrically connected to a source of direct current such that it functioned as the cathode. Contact was made to the tube at one end by a copper plate fastened to one leg of a plastic support structure. The tube was positioned centrally between two consumable copper anodes 5 inches apart and having the same length as the tube and rotated at 7–22 r.p.m. by an electric motor, gear and chain-belt drive. A current density of 500 amperes per square foot was applied for one minute to form the dendrites, and the current density was then reduced to 40 amperes per square foot and the plating continued for one hour to provide a honeycomb layer of copper over the formed dendrites. The tube was removed from the plating bath, rinsed and dried.

The thus treated tube wall surface contained approximately 62,800 cavities per square inch and the average cavity diameter was approximately 0.00108 inches. The tube was tested and found to greatly augment boiling heat transfer in dichlorodifluoromethane refrigerants (R-12). The heat transfer coefficient was 1192 B.t.u.'s per hour per square foot per °F.

EXAMPLE 2

Figure 2:
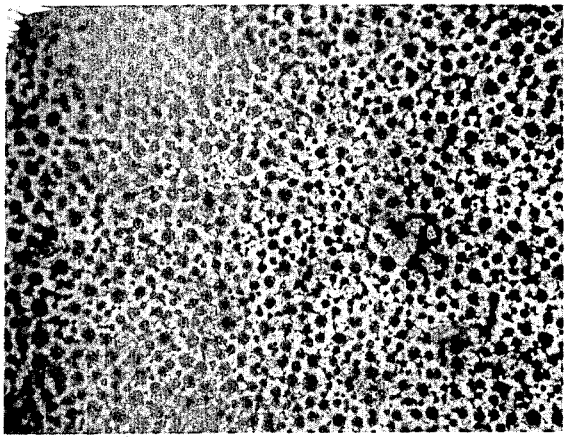
FIG. 2 is a photomicrograph (X30) of the surface of a copper tube plated in accordance with the present invention utilizing 60 mesh silicon carbide grit to deform the surface prior to plating.

The tube surface of FIG. 2 was prepared in the same manner as set forth in Example 1 above except that silicon carbide of a 60 mesh grit was utilized providing a surface having approximately 55,000 cavities per square inch with the average hole diameter of 0.00216 inches. The tube was tested in a heat transfer test cell with refrigerant R-12 and the heat transfer coefficient was 1150 B.t.u.'s per square foot per °F.

EXAMPLE 3

Figure 3:
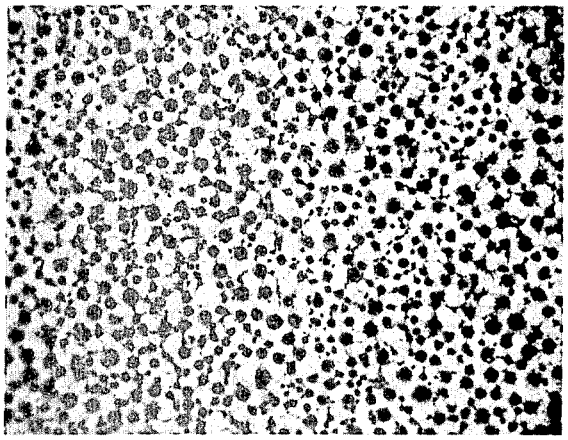
FIG. 3 is a photomicrograph (X30) of the surface of a copper tube plated in accordance with the present invention utilizing 30 mesh silicon carbide grit to deform the surface prior to plating.

The tube surface of FIG. 3 was prepared in the same manner as set forth in Example 1 above except that silicon carbide of a 30 mesh grit was utilized providing a surface having approximately 21,000 cavities per square inch with the average hole diameter of 0.0032 inches. The tube was tested and the heat transfer coefficient was 1100 B.t.u.'s per hour per square foot per °F.

EXAMPLE 4

Figure 4:
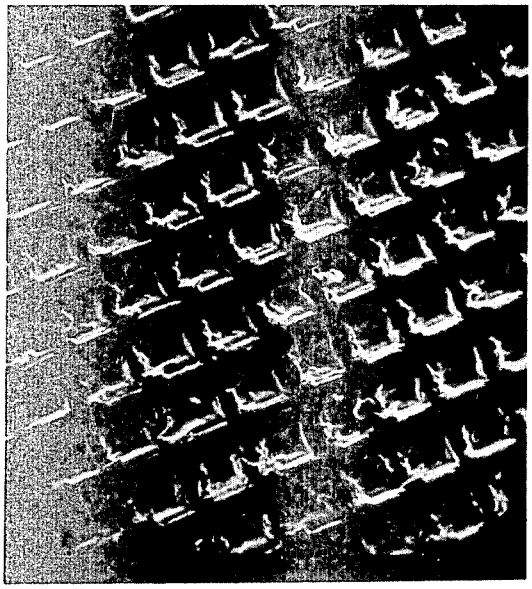
FIG. 4 is a photomicrograph (X100) of the surface of a copper tube knurled with a tool having 240 knurls/inch.

The surface of FIG. 4 was prepared by cleaning and mechanically deforming a ¾ inch O.D. copper refrigeration tube having a thickness of 0.035 inch with a knurling tool having 240 knurls/inch.

Figure 5:
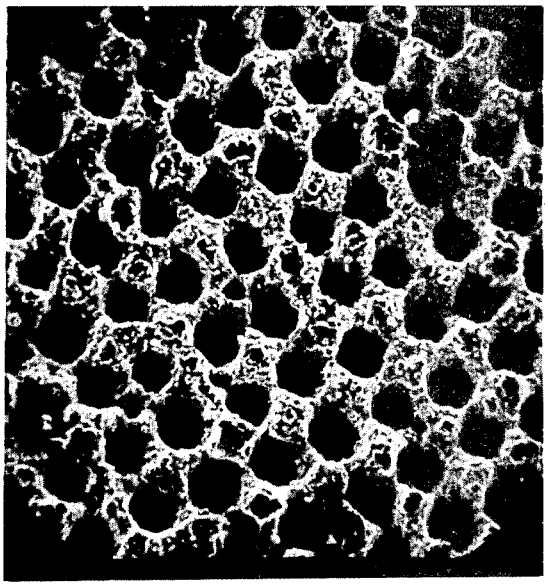
FIG. 5 is a photomicrograph (X100) of the knurled tube of FIG. 4 after plating in accordance with the present invention.
Figure 6:
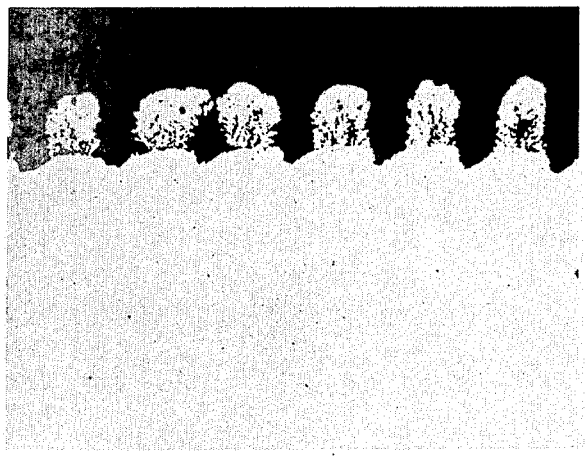
FIG. 6 is a cross-sectional view of the plated tube of FIG. 5.

The surface shown in FIGS. 5 and 6 of the drawings was formed by plating the knurled tube surface of FIG. 4 by the same method of Example 1 except that knurling was substituted for the sandblasting step. The tube was tested and found to have an average heat transfer coefficient of 1,122 B.t.u.'s per hour per square foot per °F.

Figure 7:
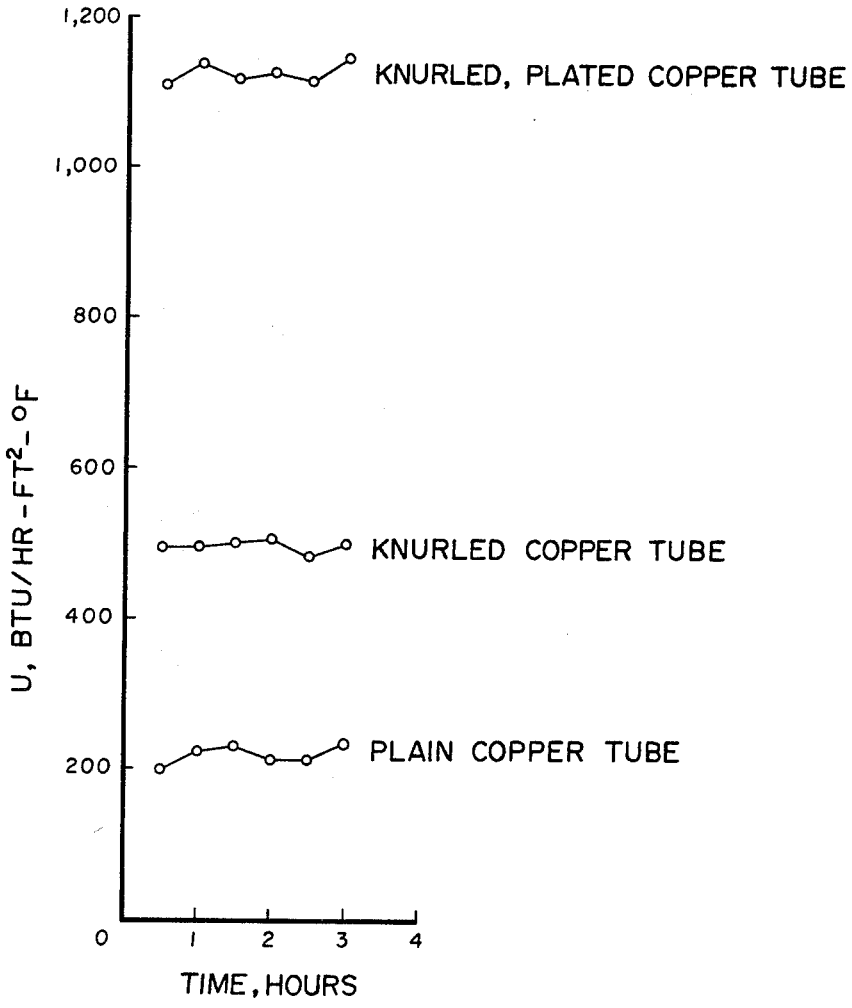
FIG. 7 is a graph comparing the efficiency of a heat transfer tube made in accordance with the present invention with an unplated, knurled tube and with a plain copper tube, in R-12 refrigerant.

FIG. 7 plots the heat transfer efficiency of the tube of FIGS. 5 and 6, the tube of FIG. 4 and of a plain surfaced copper tube. The ability of the wall surface of the tube of FIGS. 5 and 6 to enhance nucleate boiling and thus increase the heat transfer coefficient is quite obvious from the FIG. 7 graph.

In operating the electroplating bath of Example 1, it has been found that the range of copper sulfate in the form of $CuSO_4.5H_2O$ can be in the range of 120 to 180 grams per liter and the range of sulfuric acid can be from 25 to 125 grams per liter. The preferred electrolyte is described in Example 1. The current density for the electroplating for the first stage or phase of the electroplating step can range from 250 to 800 amperes per square foot with a time of 30 to 90 seconds. The current density for the second stage or phase should be less than 50 amperes per square foot with a time of from 20 to 60 minutes, or more. The preferred current density for the second stage is 40 amperes per square foot for a time period of one hour.

While this invention has been described in connection with a certain specific embodiment thereof, it is to be understood that this is by way of illustration and not by way of limitation; and the scope of the appended claims should be construed as broadly as the prior art will permit.

We claim:

1. Heat exchange apparatus comprising a heat conductive wall having one surface adapted to be in contact with a boiling liquid and the other surface adapted to be in contact with a warm fluid, said one surface being formed by (1) mechanically forming non-continuous pits or craters on said surface; (2) electrodepositing a metal on the thus pitted surface at a high current density to produce dendrites and form honeycomb-like nucleate boiling surfaces on said surface; and (3) subsequently plating said dendrites at a lower current density to coat said dendrites with a metal plate.

* * * * *